US005517284A

United States Patent [19]

Ohtake et al.

[11] Patent Number: 5,517,284

[45] Date of Patent: May 14, 1996

[54] FIXING DEVICE

[75] Inventors: Masaki Ohtake; Yoji Serizawa, both of Kawasaki, Japan

[73] Assignee: Canon Kabushiki Kaisha, Tokyo, Japan

[21] Appl. No.: 168,682

[22] Filed: Dec. 17, 1993

[30] Foreign Application Priority Data

Dec. 25, 1992 [JP] Japan ..... 4-357787

[51] Int. Cl.[6] ..... G03G 15/20

[52] U.S. Cl. ..... 355/208; 355/285

[58] Field of Search ..... 355/285, 289, 355/290, 208; 219/216, 489

[56] References Cited

U.S. PATENT DOCUMENTS

| | | | |
|---|---|---|---|
| 4,897,696 | 1/1990 | Matsumoto | 355/285 |
| 4,914,476 | 4/1990 | Nishitsuji et al. | 355/208 |
| 5,280,328 | 1/1994 | Goto et al. | 355/285 |

FOREIGN PATENT DOCUMENTS

| | | |
|---|---|---|
| 2-207286 | 8/1990 | Japan . |
| 5-333944 | 12/1993 | Japan . |

*Primary Examiner*—Nestor R. Ramirez
*Attorney, Agent, or Firm*—Robin, Blecker, Daley & Driscoll

[57] ABSTRACT

A fixing device is provided with a heating member heated by a heater, a temperature detecting member for detecting a temperature of the heating member, a controller for controlling energization of the heater so that the temperature detected by the temperature detection member becomes equal to a predetermined fixing temperature in a fixing mode, and becomes equal to a predetermined stand-by temperature lower than the fixing temperature in a stand-by mode, and a measurement unit for measuring a temperature rise rate of the heater, wherein the controller controls determination of the stand-by temperature and a switching timing from the stand-by temperature to the fixing temperature on the basis of a measurement result from the measurement unit.

11 Claims, 12 Drawing Sheets

FIXING DEVICE

BACKGROUND OF THE INVENTION

1. Field of the Invention

The present invention relates to a fixing device for thermally fixing a non-fixed image on a recording medium and, more particularly, to a fixing device for controlling the temperature of a heating member in a stand-by mode to be lower than that in a fixing mode.

2. Related Background Art

In an image forming apparatus such as a copying machine, a printer, or the like, a heat roller system for fixing a non-fixed image by guiding a recording medium which supports the non-fixed image to pass between a pair of rollers, which are heated and pressed to each other, is popularly used.

FIG. 1 is a block diagram showing a control system of an electrophotography printer.

The control system shown in FIG. 1 comprises a printer controller 401 for converting image code data supplied from a host computer into printable bit map data, and performing printing mode designation, a printing start instruction, and the like for a printer, an engine control unit 402 for controlling respective mechanism portions of the printer on the basis of an instruction from the printer controller, a paper feeding control unit 403 for performing driving/stopping operations of respective portions of a feeding system on the basis of an instruction from the engine control unit 402, a high voltage control unit 404 for outputting high voltages for charging, developing, and transfer operations on the basis of an instruction from the engine control unit, an optical system control unit 405 for performing the driving/stopping operation of a scanner motor, and the ON/OFF operation of a laser on the basis of an instruction from the engine control unit, a sensor input unit 406 for supplying input information from sensors such as a registration sensor, a paper exhaust sensor, and the like to the engine control unit, and a fixing device temperature control unit 407 for heating a fixing roller on the basis of an instruction from the engine control unit.

With the above-mentioned control system, the fixing device performs temperature control shown in the flow chart in FIG. 2. As shown in FIG. 2, when a power supply is turned on, the engine control unit initializes the printer, and thereafter, performs temperature control for maintaining the fixing device at a stand-by temperature in a non-printing state. This temperature control is realized by fetching a voltage value read by a thermoelectric element (e.g., a thermistor) attached to the fixing roller by a CPU via an A/D converter in the engine control unit. The fetched A/D-converted value is compared to an A/D-converted value corresponding to the stand-by temperature, and processing for turning off a fixing heater when the fixing roller temperature is higher than the stand-by temperature, and for turning on the fixing heater when the fixing roller temperature is lower than the stand-by temperature, is executed until a printing request of the printer controller is received. Upon reception of a printing request, processing for building up the temperature of the fixing roller to the printing temperature is performed simultaneously with processing for driving a scanner, processing for driving the feeding system, and processing for building up high voltages.

Thereafter, processing for turning off the fixing heater when the fixing roller temperature is higher than the printing temperature and for turning on the fixing heater when the fixing roller temperature is lower than the printing temperature, is continued until the printing operation ends. The stand-by temperature of the fixing roller is set to be lower than the printing temperature, and the temperature difference therebetween is fixed to be a temperature value, which can be sufficiently built up from when a printing request is received until a paper sheet reaches the fixing device.

The stand-by temperature is set at a relatively high temperature in correspondence with various environments where the printer is set, so that the fixing roller temperature can be sufficiently built up to the printing temperature after reception of a printing request until a paper sheet reaches the fixing rollers. Therefore, the temperature difference from the printing temperature is small, and the heater ON ratio in the stand-by mode increases, thus consuming excessive electric power.

Furthermore, since a temperature rise to the printing temperature is started after reception of a printing request, the fixing roller temperature may reach the printing temperature before a paper sheet reaches the fixing device depending on the environment of the printer. In this case, excessive electric power is consumed.

SUMMARY OF THE INVENTION

It is an object of the present invention to provide a fixing device which can prevent excessive electric power consumption before a fixing operation is started.

It is another object of the present invention to provide a fixing device being provided with a heating member heated by a heater; a temperature detection member for detecting a temperature of the heating member; control means for controlling energization to the heater so that the temperature detected by the temperature detection member becomes equal to a predetermined fixing temperature in a fixing mode, and becomes equal to a predetermined stand-by temperature lower than the fixing temperature in a stand-by mode; and measurement means for measuring a temperature rise rate of the heater, wherein the control means controls determination of the stand-by temperature and a switching timing from the stand-by temperature to the fixing temperature on the basis of a measurement result from the measurement means.

Other objects of the present invention will become apparent from the following description.

DESCRIPTION OF THE PREFERRED EMBODIMENTS

Figure 3:
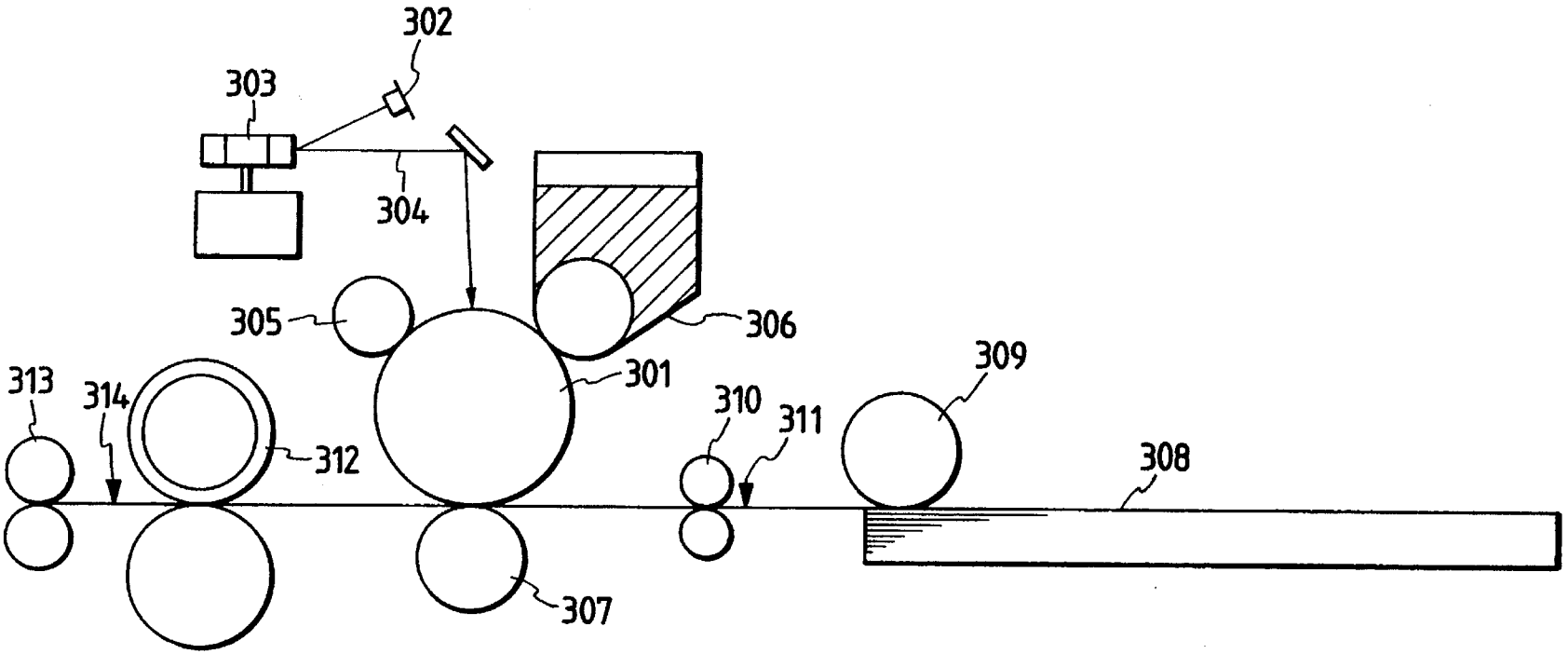
FIG. 3 is a schematic sectional view of an image forming apparatus.

FIG. 3 is a schematic sectional view of a laser beam printer as an image forming apparatus using a fixing device according to an embodiment of the present invention. In FIG. 3, reference numeral 301 denotes a photosensitive drum which is a member for carrying an electrostatic latent image, 302 is a semiconductor laser which is a light source, 303 is a rotatable polygon mirror, 304 is a laser beam scanning on the photosensitive drum 301 by the rotatable polygon mirror 303, 305 is a charging roller for charging the photosensitive drum 301 uniformly, 306 is a development device for developing the electrostatic latent image to a toner image, 307 is a transfer roller for transferring the toner image to a predetermined sheet being carried, 308 is a sheet cassette for stacking the sheets, a sheet feed 309 is roller for feeding the sheet from the sheet cassette to the feed path, 310 is a resist roller for correcting the slant movement of the sheet by contacting the sheet and for synchronizing image writing onto the photosensitive drum with sheet feeding, 311 is a resist sensor for detecting presence or absence of the sheet, 312 is a fixing roller for fusing the transferred toner onto the sheet, 313 is a discharging roller for discharging the sheet after image fixing to the outside of the apparatus, and 314 is a sensor for confirming the discharge of the sheet.

Figure 12:
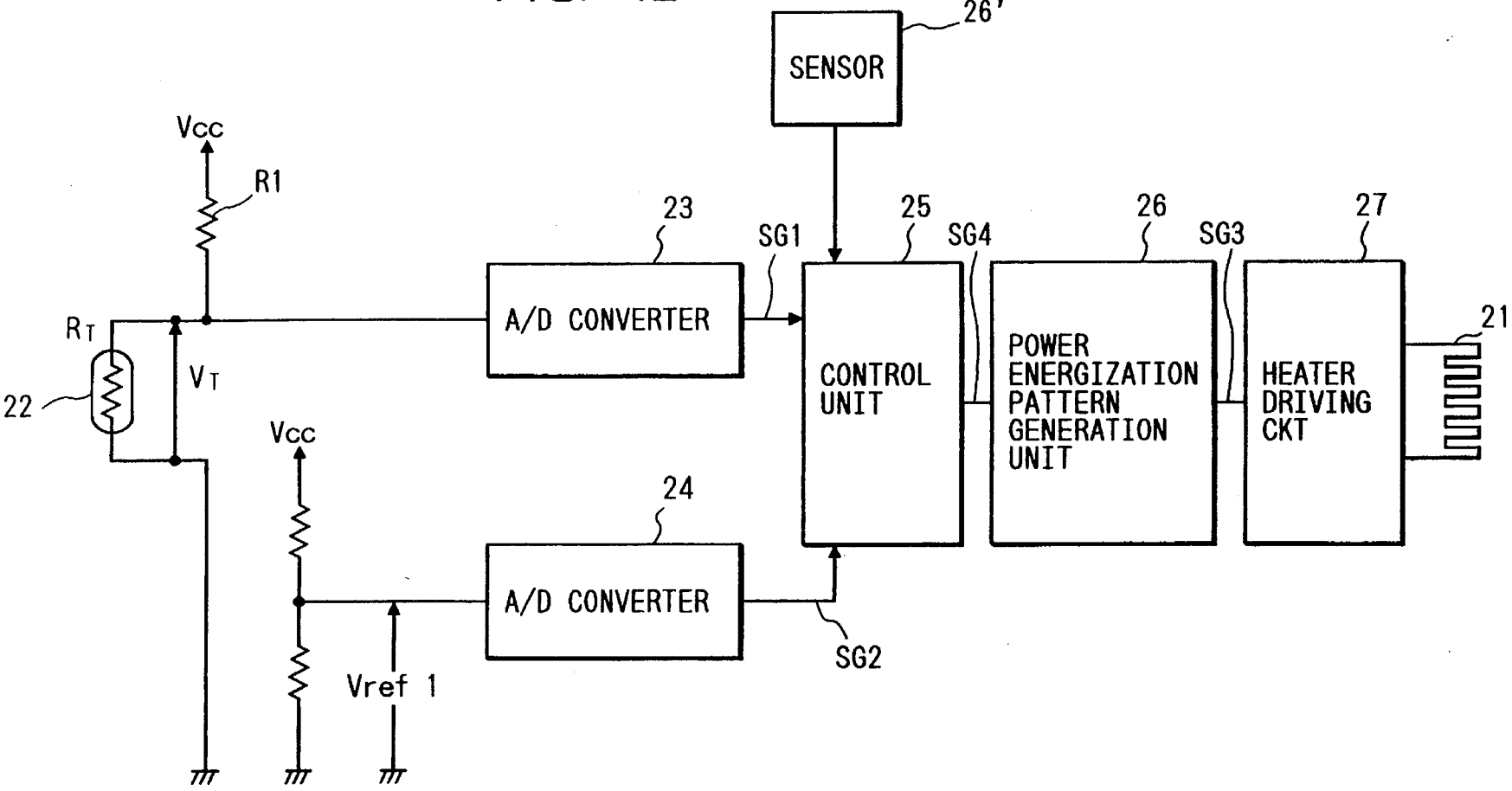
FIG. 12 is a block diagram showing a heater control circuit of a fixing device in the embodiment.

FIG. 12 is a heater control circuit of the heating fixing device. A halogen heater 21 generates heat upon reception of electric power, and its energization is controlled, so that the resistance of a thermistor 22 as a temperature detection element arranged to be in contact with the surface of a fixing roller becomes constant with respect to a reference. An A/D converter 23 obtains a digital value from a voltage VT obtained by the voltage dividing ratio between the thermistor and a resistance R1. An A/D converter 24 obtains a digital value from a control target voltage Vref1. The A/D converters 23 and 24 output digital values SG1 and SG2 to a control unit 25 (to be described later). A power energization pattern generation unit 26 outputs a heater control signal SG3 to a heater driving circuit 27 on the basis of a pattern from the control unit 25. The control unit 25 performs heating control of the heater in accordance with an input from a sensor 26' and the digital value SG1. The control unit 25 performs temperature control using the signal SG2 from the A/D converter, which signal is a digital value of the control target value Vref1 optimal for fixing.

An embodiment of the present invention will be described below with reference to FIGS. 4 to 7.

Figure 4:
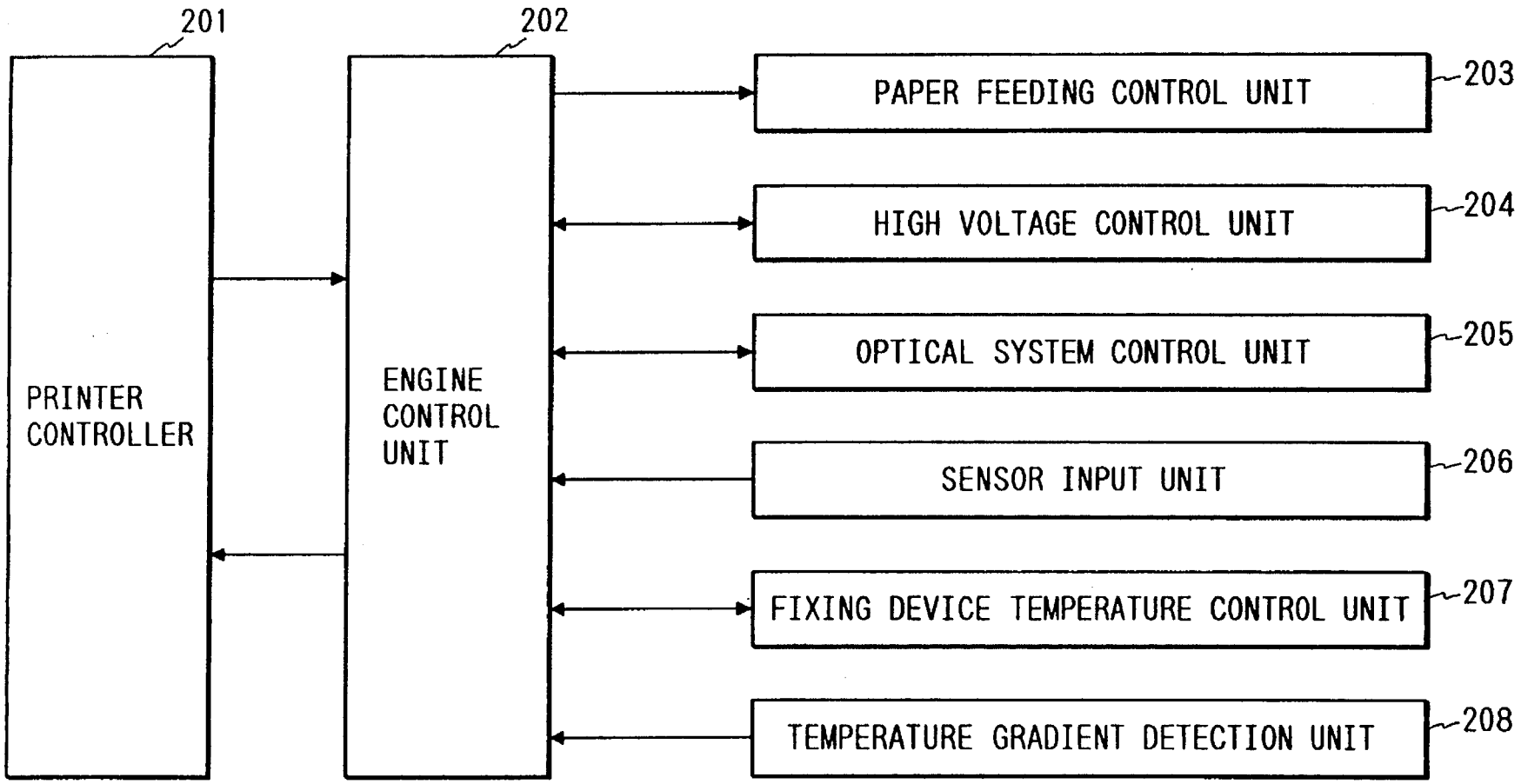
FIG. 4 is a block diagram of a control unit according to an embodiment of the present invention.

FIG. 4 is a control block diagram.

Figure 1:
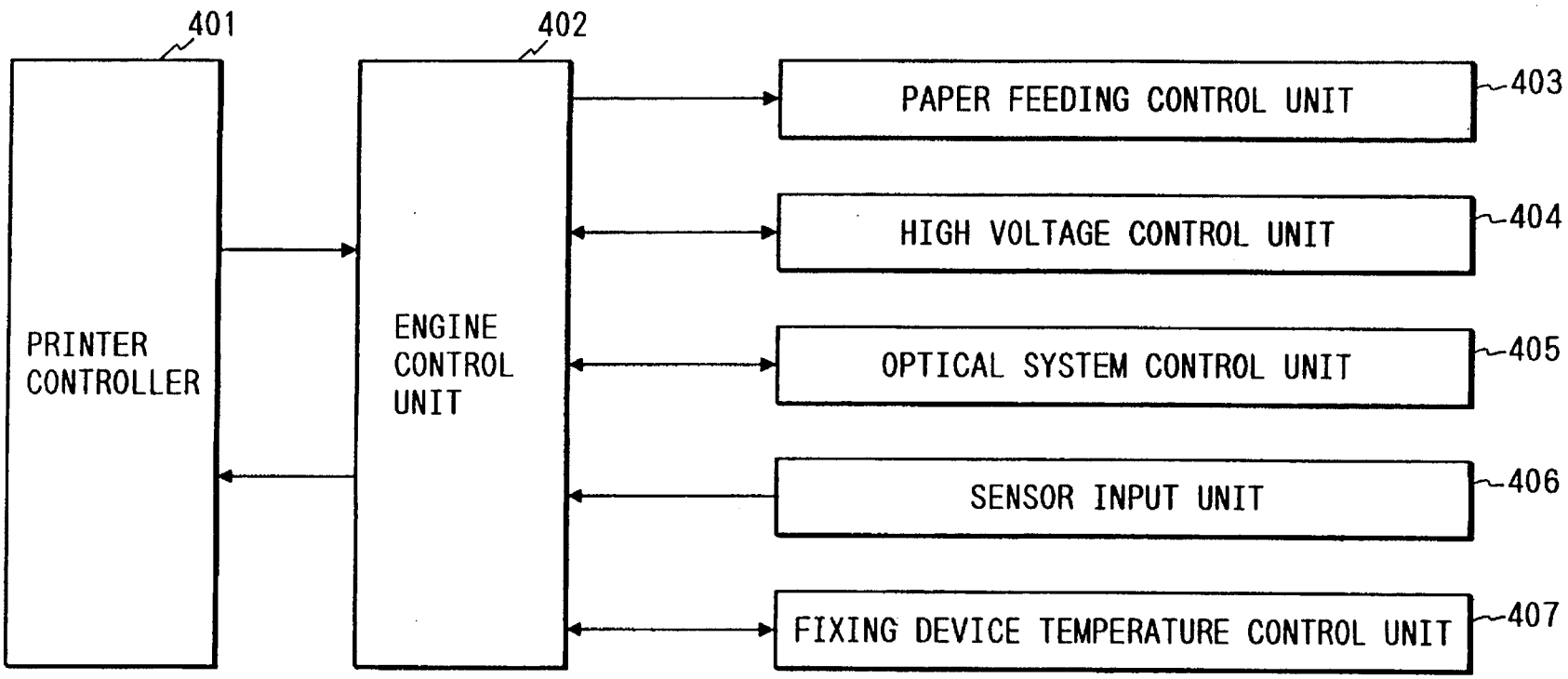
FIG. 1 (PRIOR ART)
FIG. 1 is a block diagram of a control unit of an image forming apparatus.
Figure 2:
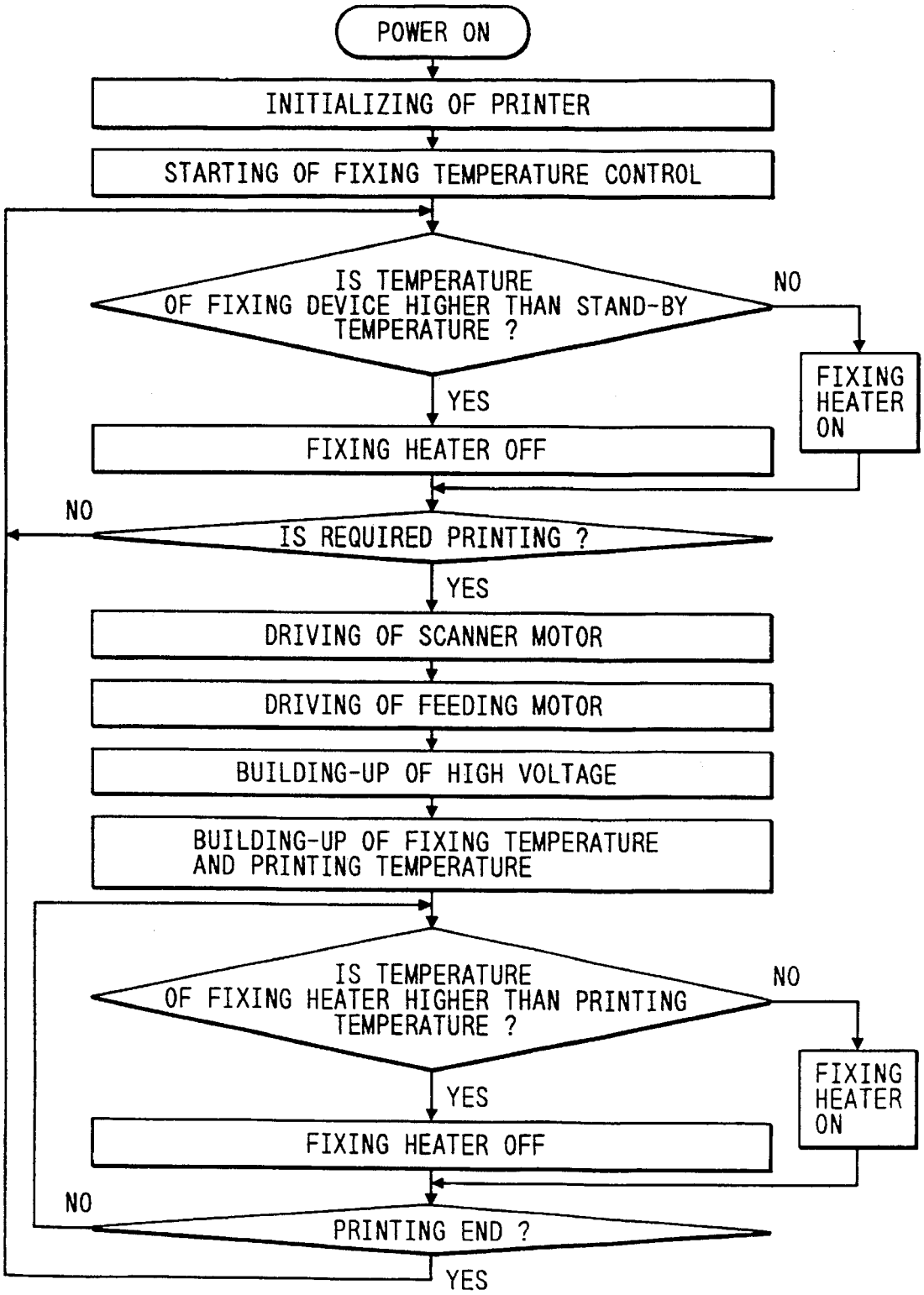
FIG. 2 (PRIOR ART)
FIG. 2 is a flow chart showing temperature control of a fixing device.

This embodiment has a temperature gradient detection unit 208 in addition to the arrangement shown in FIG. 1.

The temperature gradient detection unit 208 detects the temperature rise rate per unit time of the fixing temperature when the fixing temperature is built up in a power-ON state.

Figure 5:
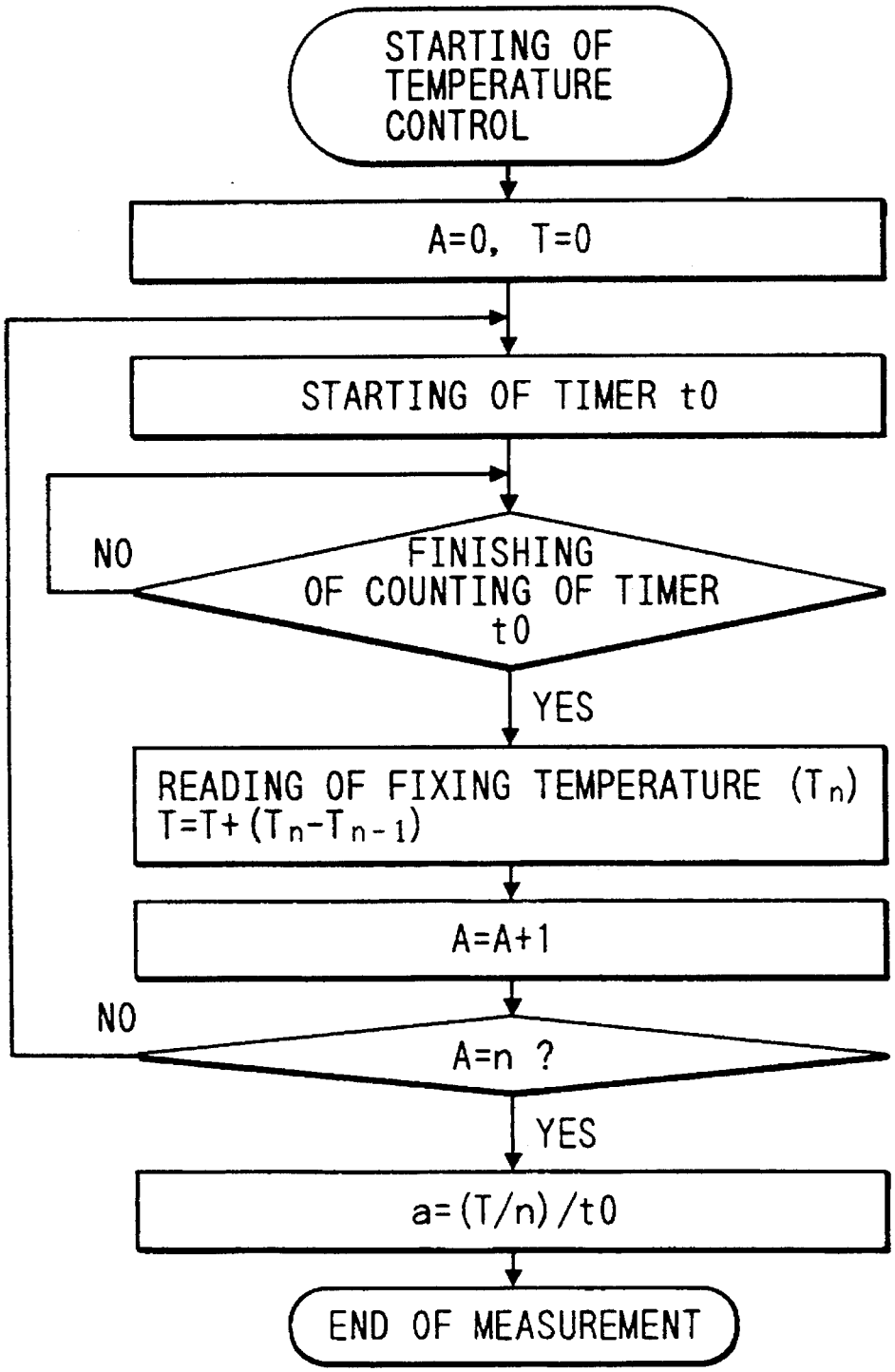
FIG. 5 is a flow chart showing a temperature gradient calculation method in the embodiment shown in FIG. 4.

Control in the temperature gradient detection unit 208 will be described below with reference to the flow chart in FIG. 5. The temperature gradient is obtained from a temperature increment after an elapse of time $t_0$ from the beginning of temperature control. In this embodiment, as shown in FIG. 5, the fixing temperature is sampled n times ($n \geqq 1$), and the average value of the temperature is calculated, thereby improving precision of the temperature rise rate.

If the calculated temperature rise rate is represented by a (°C./sec), the time after reception of a printing signal until a paper leading end reaches the fixing roller is represented by $t_L$, and the printing temperature is represented by $T_P$, a stand-by temperature $T_s$ is given by:

$$T_S = T_P - a \times t_L \text{ (°C.)}$$

More specifically, under any environment (high or low temperature), when the temperature rise rate is calculated, an optimal stand-by temperature can be set, so that the roller temperature can be reliably raised to the printing temperature before a paper leading end reaches the fixing roller in a printing mode.

Figure 6:
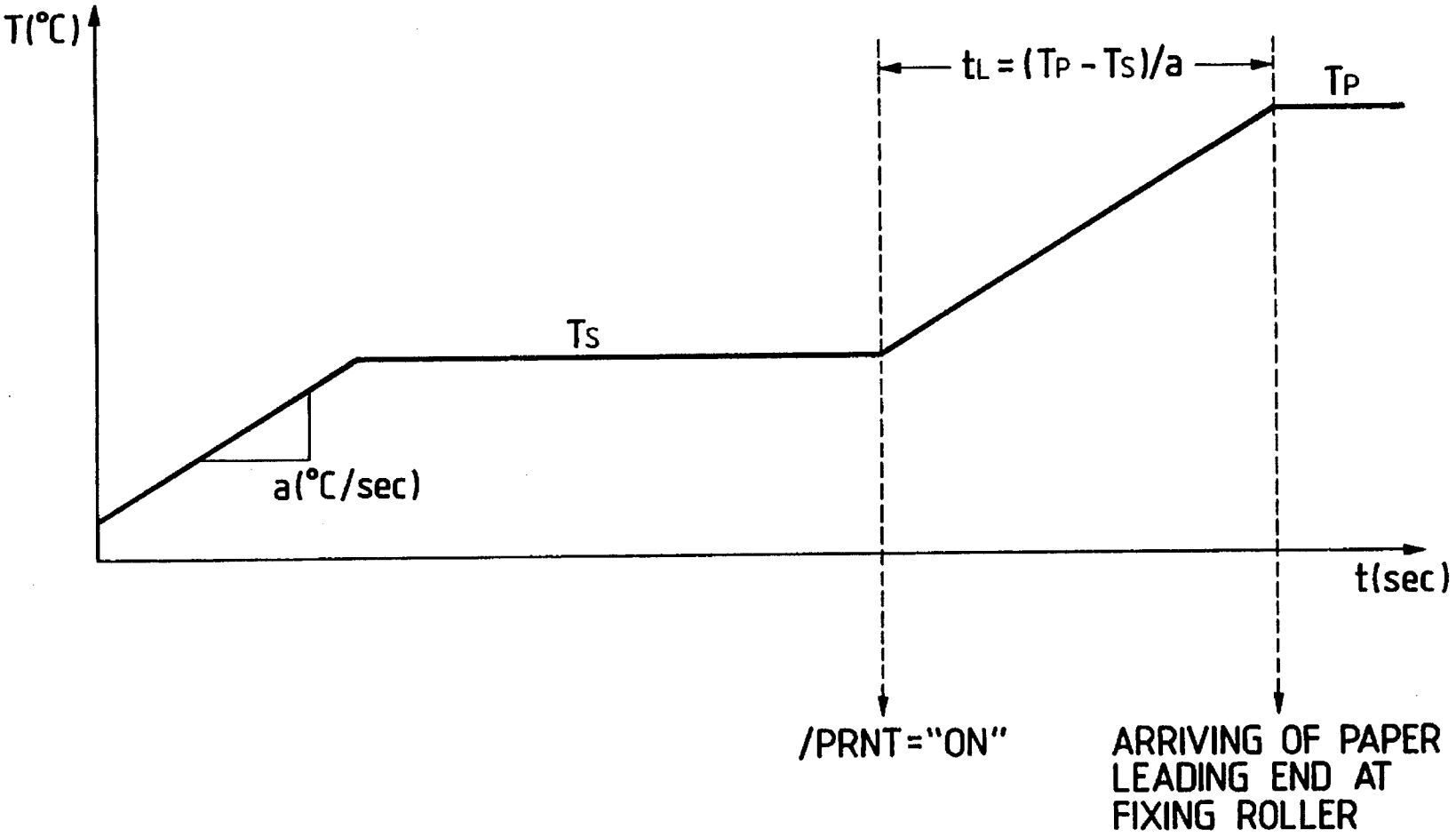
FIG. 6 is a graph showing a change in temperature of a fixing device in the embodiment shown in FIG. 4.

The time $t_L$ is the time required after reception of a printing signal until a paper leading end reaches the fixing roller, as shown in FIG. 6. This time $t_L$ is calculated based on the building-up time of a scanner motor, or the feeding path length and feeding speed. Therefore, in this embodiment, the time $t_L$ is calculated by either one of the following two equations. If the building-up time of the scanner motor is represented by $t_1$, and the feeding time from a registration roller to the fixing device is represented by $t_2$, the time $t_L$ is given by:

$$t_L = t_1 + t_2$$

If the paper supply time is represented by $t_3$, the time $t_L$ is given by:

$$t_L = t_3 + t_2$$

In the former case, i.e., in a system wherein the building-up time of the scanner motor is sufficiently larger than the paper supply time, the calculation of $t_L$ may be realized by measuring the building-up time of the scanner motor in a power-ON state or by setting a predetermined fixed value. When the paper supply time is larger than the building-up time of the scanner motor, $t_L$ can be set in advance based on a time calculated from the feeding distance and speed.

Figure 7:
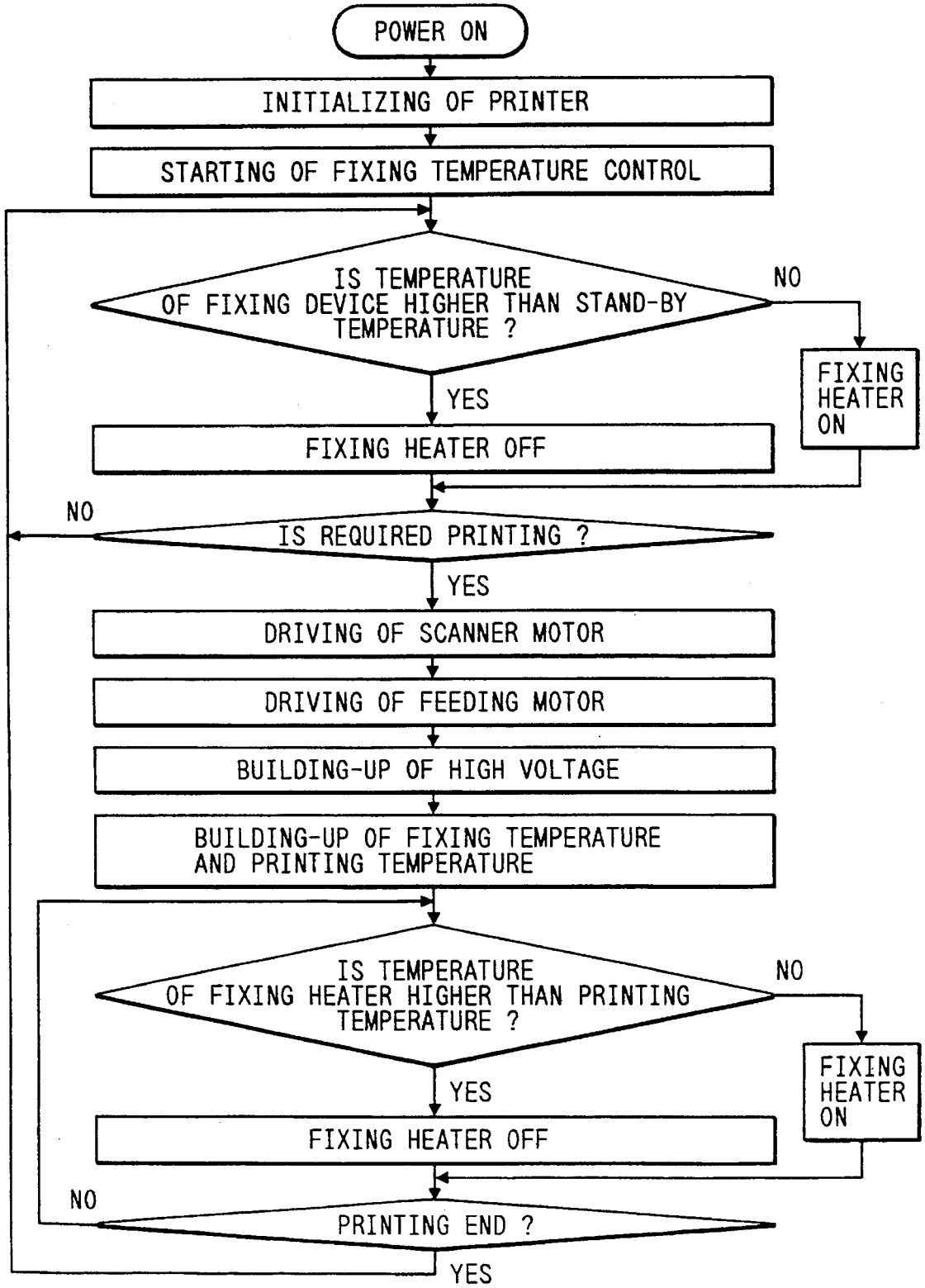
FIG. 7 is a flow chart showing a temperature control method in the embodiment shown in FIG. 4.

Temperature control in this embodiment will be described below. As shown in FIG. 7, when a power supply is turned on, an engine control unit initializes a printer. Thereafter, the engine control unit calculates the stand-by temperature by the above-mentioned method so as to hold the fixing device at a stand-by temperature in a non-printing state, and performs temperature control. The temperature control is realized by fetching a voltage value read by a thermoelectric element (e.g., a thermistor) attached to the fixing roller by a CPU via an A/D converter in the engine control unit. The fetched A/D-converted value is compared to an A/D-converted value corresponding to the stand-by temperature, and processing for turning off a fixing heater when the fixing roller temperature is higher than the stand-by temperature, and for turning on the fixing heater when the fixing roller temperature is lower than the stand-by temperature is executed until a printing request of the printer controller is received. Upon reception of a printing request, processing for building up the temperature of the fixing roller to the printing temperature is performed simultaneously with processing for driving a scanner, processing for driving the feeding system, and processing for building up high voltages.

Thereafter, processing for turning off the fixing heater when the fixing roller temperature is higher than the printing temperature, and for turning on the fixing heater when the fixing roller temperature is lower than the printing temperature is continued until the printing operation ends.

Figure 8:
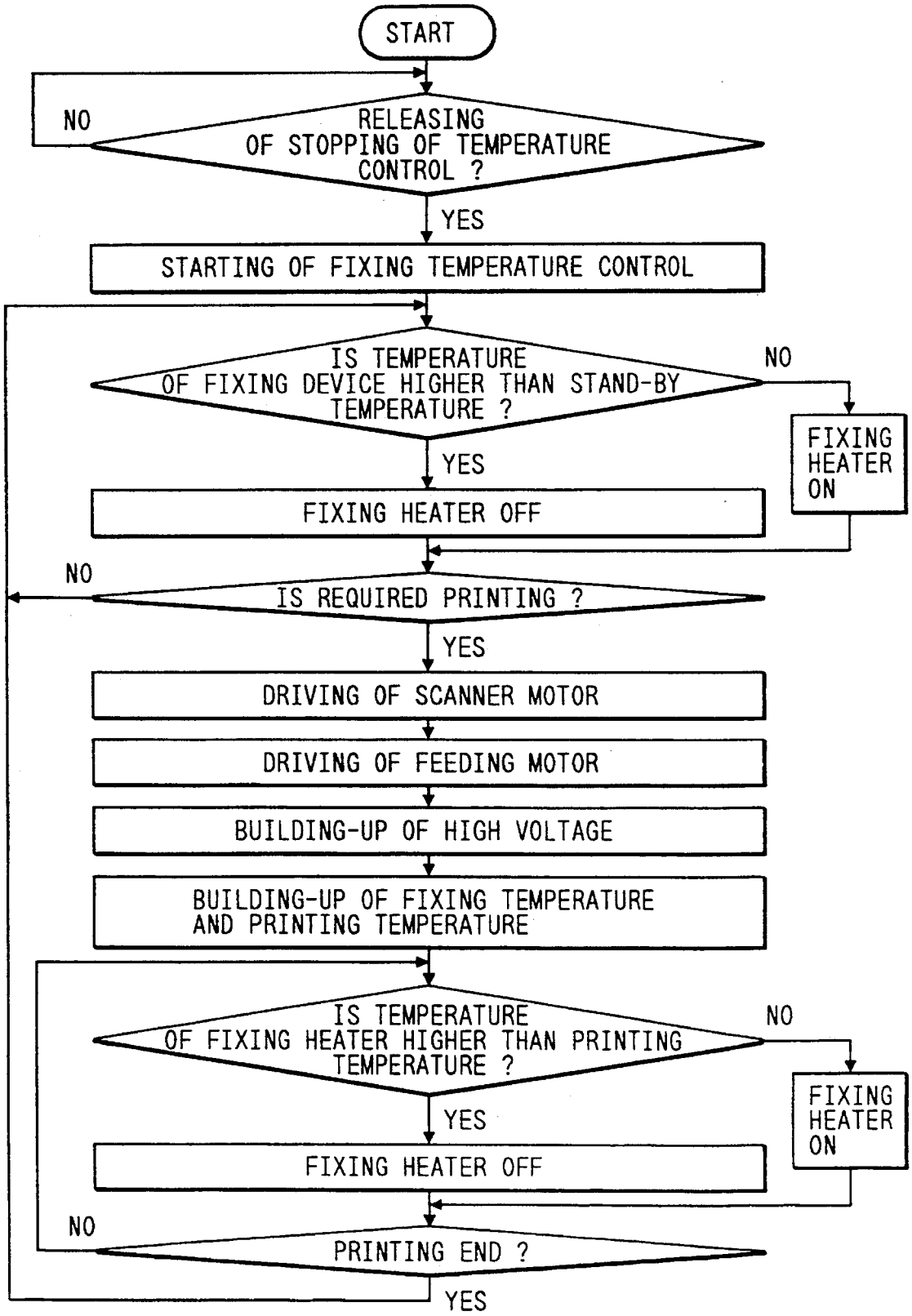
FIG. 8 is a flow chart showing a temperature control method according to another embodiment of the present invention.

FIG. 8 is a flow chart showing another embodiment of the present invention.

In this embodiment, temperature control in a recovery state from a temperature control stop mode wherein stand-by temperature control of the fixing device is stopped in accordance with an instruction from the printer controller will be described.

FIG. 8 is a processing flow chart in a recovery state from the temperature control stop mode. Basic control is the same as that described above with reference to FIG. 7.

In this manner, even when the temperature is restored from a mode such as the temperature control stop mode wherein the temperature of the fixing device temporarily decreases to a temperature near room temperature, the stand-by temperature can be determined from the temperature gradient.

Figure 9:
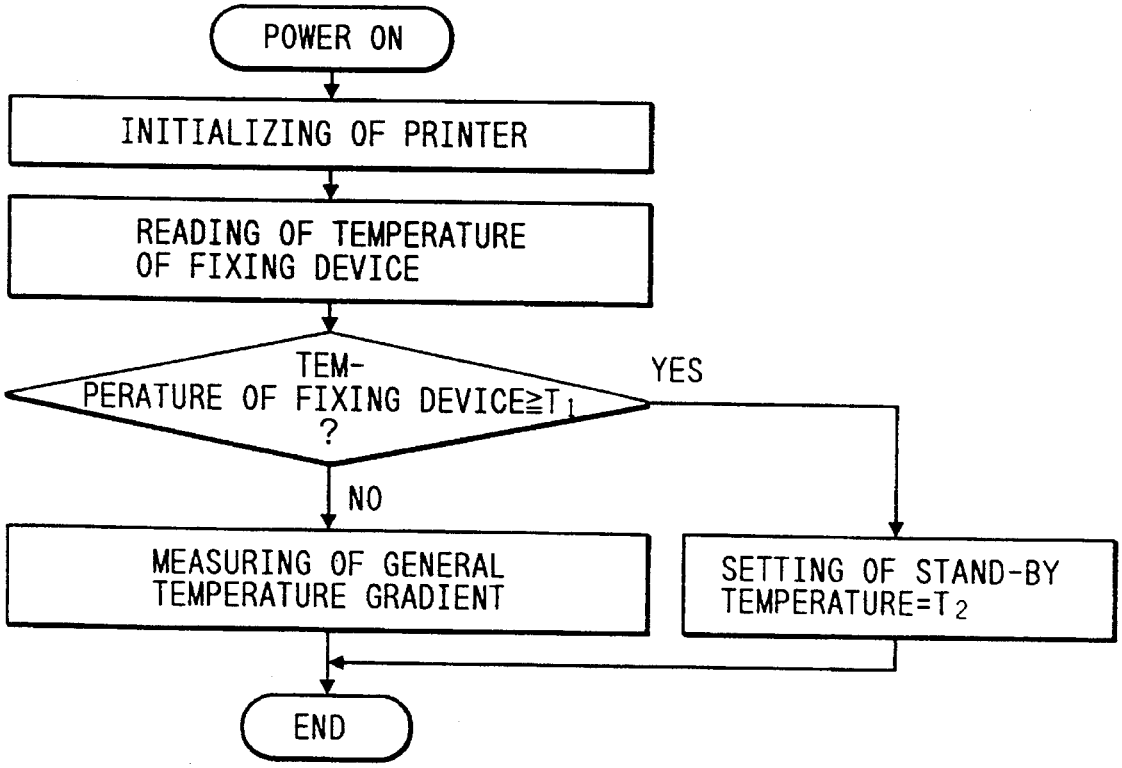
FIG. 9 is a flow chart showing a stand-by temperature setting method according to still another embodiment of the present invention.

FIG. 9 shows still another embodiment of the present invention.

When a user operates a printer, a paper jam may occur during a printing operation. If a paper jam occurs, the user temporarily turns off the power supply to remove a jammed paper sheet, and thereafter, turns on the power supply. In this case, the temperature of the fixing device is slightly lower than the printing temperature, and the building-up processing of the fixing device is not required. In this embodiment, processing in such an abnormal state will be described.

FIG. 9 is a flow chart showing stand-by temperature setting processing of this embodiment. When the power supply is turned on, the temperature of the fixing device is read. When the read temperature is higher than a predetermined temperature $T_1$ (°C.), since the temperature gradient cannot be measured, a pre-set temperature $T_2$ is set to be a stand-by temperature control temperature. In this case, when the engine control unit includes a nonvolatile memory in which data is not lost even in a power-OFF state, the stand-by temperature can be set by utilizing a temperature gradient a (°C./sec) measured when the fixing device temperature was lower than the temperature $T_1$ (°C.) in a power-ON state.

The temperature $T_1$ is set in advance on the basis of the time required for measuring the temperature gradient, and the time required until the temperature gradient is stabilized.

Figure 10:
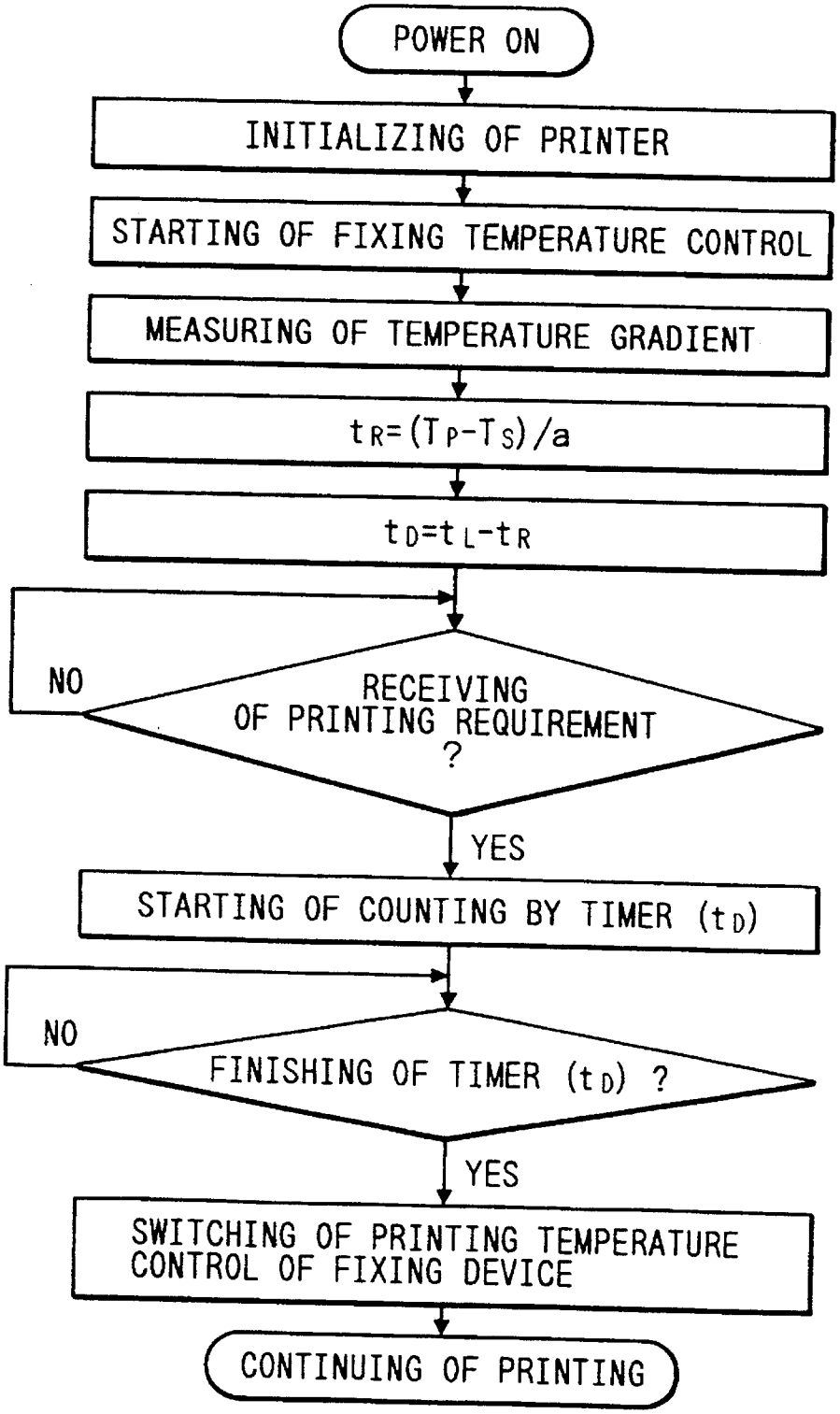
FIG. 10 is a flow chart showing a temperature control method in the embodiment shown in FIG. 9.
Figure 11:
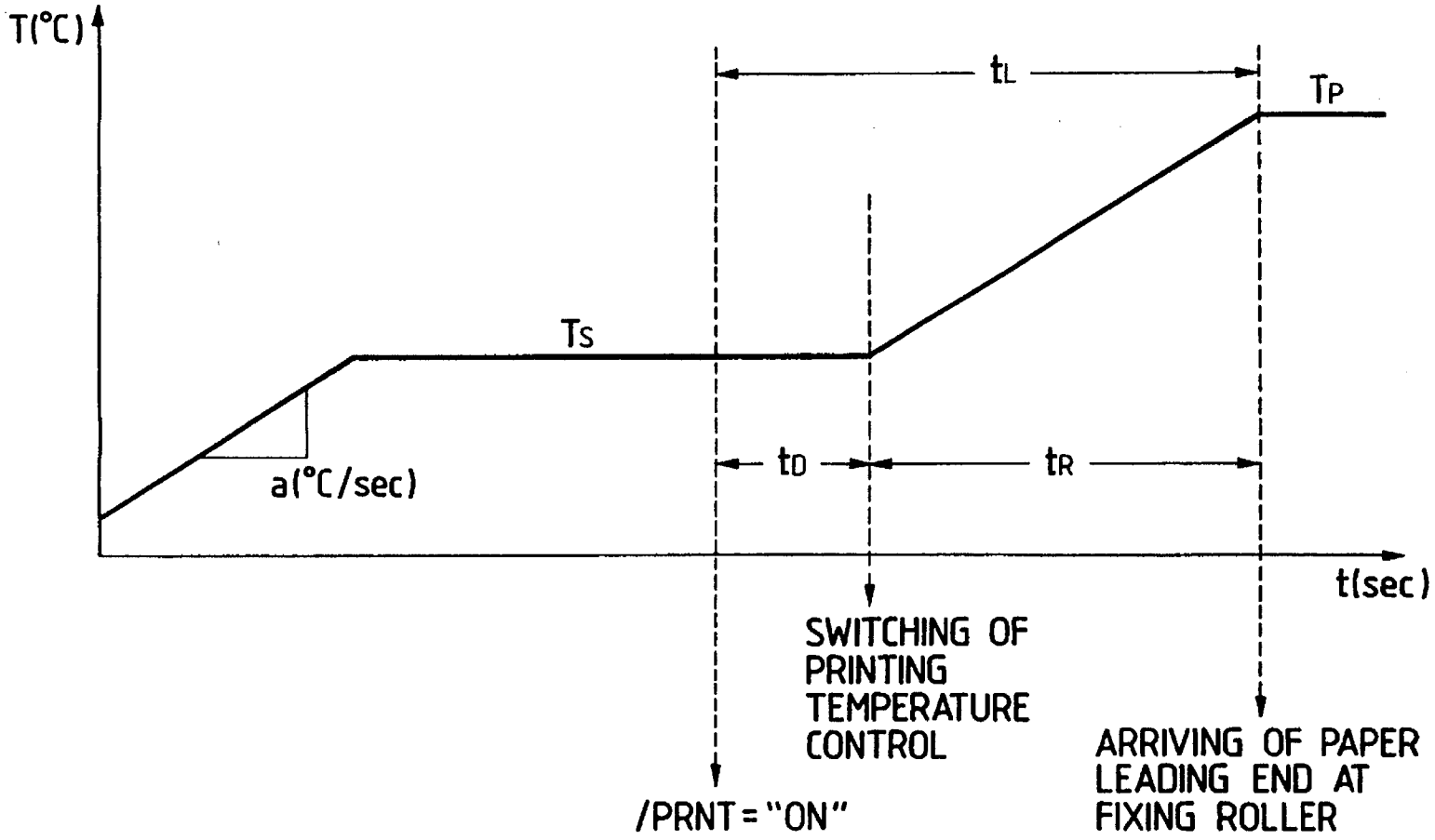
FIG. 11 is a graph showing a change in temperature of a fixing device in the embodiment shown in FIGS. 9 and 10.

FIGS. 10 and 11 show still another embodiment of the present invention.

In each of the above embodiments, the stand-by temperature is set based on the temperature gradient of the fixing device. However, in this embodiment, when temperature control of the fixing device is executed after reception of a printing request, the timing for switching the stand-by temperature to the printing temperature is adjusted.

More specifically, as the stand-by temperature, a predetermined fixed value is set, and the timing for switching the predetermined temperature to the printing temperature is varied.

FIG. 10 is a flow chart showing temperature control of this embodiment. After a power supply is turned on, a printer is initialized. Thereafter, a temperature gradient a (°C./sec) is measured. A building-up time $t_R$ from a stand-by temperature $T_S$ to a printing temperature $T_P$ is calculated using the following equation:

$$t_R=(T_P-T_S)/a$$

A difference ($t_D$) obtained by subtracting the time $t_R$ from the time $t_L$ from the reception of a printing request until a paper leading end reaches the fixing roller is determined to be a delay time after reception of the printing request until the printing temperature control is started. FIG. 11 shows a change in temperature by this processing over time.

In this manner, even when the stand-by temperature is fixed in advance at $T_S$ (°C.), the temperature control switching timing after reception of a printing request can be delayed from a conventional timing by measuring the temperature gradient a (°C./sec), and can be set to be an optimal timing.

The embodiments of the present invention have been described. However, the present invention is not limited to these embodiments, and various other modifications may be made within the spirit and scope of the invention.

What is claimed is:

1. A fixing device comprising:

a heating member heated by a heater;

a temperature detection member for detecting a temperature of said heating member;

control means for controlling energization to said heater on the basis of the temperature detected by said temperature detection member, said control means controlling energization of said heater so that the temperature detected by said temperature detection member becomes equal to a predetermined fixing temperature in a fixing mode, and becomes equal to a determined stand-by temperature lower than the fixing temperature in a stand-by mode; and measurement means for measuring a temperature rise rate of said heater, wherein said control means determines the determined stand-by temperature on the basis of a measurement result from said measurement means.

2. An apparatus according to claim 1, further comprising a back up member for forming a nip together with said heating member, and wherein fixing is performed by clamping and feeding a recording medium which supports a non-fixed image.

3. An apparatus according to claim 2, wherein said heating member comprises a heating roller.

4. An apparatus according to claim 1, wherein said measurement means measures the temperature rise rate during an interval from the beginning of energization of said heating member until the temperature of said heating member reaches the stand-by temperature.

5. An apparatus according to claim 1, wherein said control means sets a low stand-by temperature when the temperature rise rate is high.

6. A fixing device comprising:

a heating member heated by a heater;

a temperature detection member for detecting a temperature of said heating member;

control means for controlling energization of said heater on the basis of the temperature detected by said temperature detection member, said control means controlling energization of said heater so that the temperature detected by said temperature detection member becomes equal to a predetermined fixing temperature in a fixing mode, and becomes equal to a stand-by temperature lower than the fixing temperature in a stand-by mode; and measurement means for measuring a temperature rise rate of said heater, wherein said control means controls a switching timing during the stand-by mode to energize said heater to attain the fixing temperature on the basis of a measurement result from said measurement means.

7. An apparatus according to claim 6, further comprising a back up member for forming a nip together with said heating member, and wherein fixing is performed by clamping and feeding a recording medium which supports a non-fixed image.

8. An apparatus according to claim 7, wherein said heating member comprises a heating roller.

9. An apparatus according to claim 6, wherein said heating member comprises a heating roller.

10. An apparatus according to claim 6, wherein said measurement means measures the temperature rise rate during an interval from a beginning of energization of said heating member until the temperature of said heating member reaches the stand-by temperature.

11. An apparatus according to claim 6, wherein said control means delays the switching time when the measurement result from said measurement means indicates that the temperature rise rate is high.

* * * * *

UNITED STATES PATENT AND TRADEMARK OFFICE

CERTIFICATE OF CORRECTION

PATENT NO. : 5,517,284

DATED : May 14, 1996

INVENTOR(S) : Masaki Ohtake, et al.

It is certified that error appears in the above-indentified patent and that said Letters Patent is hereby corrected as shown below:

On the title page, Item [54], after "FIXING DEVICE" insert -- CONTROLLED ON THE BASIS OF A MEASURED TEMPERATURE RISE RATE --.

Col. 1, line 1, after "FIXING DEVICE" insert -- CONTROLLED ON THE BASIS OF A MEASURED TEMPERATURE RISE RATE --.

Col. 3, line 29, before "a sheet" insert -- 309 is -- and before "roller" delete "309 is".

Signed and Sealed this

Fifth Day of November, 1996

*Attest:*

Bruce Lehman

BRUCE LEHMAN

*Attesting Officer*

*Commissioner of Patents and Trademarks*